United States Patent [19]

Ohe et al.

[11] Patent Number: 4,789,866

[45] Date of Patent: Dec. 6, 1988

[54] AUTOMOBILE ANTENNA SYSTEM

[75] Inventors: Junzo Ohe; Hiroshi Kondo, both of Aichi, Japan

[73] Assignee: Toyota Jidosha Kabushiki Kaisha, Toyota, Japan

[21] Appl. No.: 795,836

[22] Filed: Nov. 7, 1985

[30] Foreign Application Priority Data

| | | | |
|---|---|---|---|
| Nov. 8, 1984 | [JP] | Japan | 59-236332 |
| Nov. 15, 1984 | [JP] | Japan | 59-242100 |
| Nov. 27, 1984 | [JP] | Japan | 59-251241 |

[51] Int. Cl.[4] ..... H01Q 1/32; H01Q 7/00

[52] U.S. Cl. ..... 343/712; 343/713; 343/741; 343/842; 343/866; 455/193

[58] Field of Search ..... 343/711–714, 343/702, 741, 744, 748, 788, 856, 867–870, 873, 904, 905, 842, 866; 333/17 R, 17 M; 455/77, 82–83, 120–123, 193, 269, 274–276

[56] References Cited

U.S. PATENT DOCUMENTS

| | | | |
|---|---|---|---|
| 2,200,674 | 5/1940 | McDonald, Jr. | 343/702 |
| 2,212,253 | 8/1940 | Stief | 343/215 |
| 2,404,093 | 7/1946 | Roberts | 343/708 |
| 2,481,978 | 9/1949 | Clough | 343/712 |

(List continued on next page.)

FOREIGN PATENT DOCUMENTS

| | | |
|---|---|---|
| 0181120 | 5/1986 | European Pat. Off. . |
| 0181200 | 5/1986 | European Pat. Off. . |
| 0181765 | 5/1986 | European Pat. Off. . |
| 0182497 | 5/1986 | European Pat. Off. . |
| 0183523 | 6/1986 | European Pat. Off. . |
| 0183520 | 6/1986 | European Pat. Off. . |
| 0183443 | 6/1986 | European Pat. Off. . |
| 889618 | 9/1953 | Fed. Rep. of Germany . |
| 1131762 | 6/1962 | Fed. Rep. of Germany . |
| 1949828 | 10/1968 | Fed. Rep. of Germany . |
| 7015306 | 9/1970 | Fed. Rep. of Germany . |
| 2425189 | 12/1974 | Fed. Rep. of Germany . |
| 2701921 | 7/1978 | Fed. Rep. of Germany . |
| 2745475 | 4/1979 | Fed. Rep. of Germany . |
| 2821202 | 11/1979 | Fed. Rep. of Germany . |
| 2733478 | 4/1980 | Fed. Rep. of Germany . |
| 2733478 | 4/1980 | Fed. Rep. of Germany . |
| 0046617 | 4/1970 | Japan . |
| 53-22418 | 7/1978 | Japan . |
| 53-34826 | 8/1978 | Japan . |
| 60-1008 | 6/1983 | Japan . |
| 60-1009 | 6/1983 | Japan . |
| 60-1010 | 6/1983 | Japan . |
| 60-1011 | 6/1983 | Japan . |
| 60-1012 | 6/1983 | Japan . |
| 129464 | 2/1984 | Japan . |
| 59-44861 | 3/1984 | Japan . |

OTHER PUBLICATIONS

Abstract–Japanese Patent Document 55–88407, Jul. 1980; 1 page.

Abstract–Japanese Patent Document 60–172804, Sep. 1985; 1 page.

Abstract–Japanese Patent Document 60–169204, Sep. 1985; 1 page.

*Primary Examiner*—Marvin L. Nussbaum

*Attorney, Agent, or Firm*—Cushman, Darby & Cushman

[57] ABSTRACT

The present invention provides an automobile antenna system including a high-frequency pick-up device for receiving broadcast waves and which includes a loop antenna or detection electrode element disposed parallel and in close proximity to the marginal edge of the vehicle body and spaced from the marginal edge of the vehicle body within a range represented by $12\times10^{-3}$ $\lambda$(m) where $\lambda$ is the wavelength of a given broadcast wave measured metric units, to detect surface high-frequency currents on the marginal portion of the vehicle body. The high-frequency pick-up device is connected with a varactor diode to adjust the resonance frequency of the antenna system. The tuned frequency of a receiver is used to vary a voltage applied to the cathode of the varactor diode such that the frequency of the antenna system will coincide with the tuned frequency of the receiver.

8 Claims, 14 Drawing Sheets

U.S. PATENT DOCUMENTS

| | | | |
|---|---|---|---|
| 2,520,986 | 9/1950 | Williams et al. | 343/867 X |
| 2,575,471 | 11/1951 | Schweiss et al. | 343/712 |
| 2,740,113 | 3/1956 | Hemphill | 343/787 |
| 2,774,811 | 12/1956 | Shanok et al. | 343/711 |
| 2,859,441 | 11/1958 | Rosenbaum | 343/712 |
| 2,950,479 | 8/1960 | Pan | 343/702 |
| 2,971,191 | 2/1961 | Davis | 343/712 |
| 3,007,164 | 10/1961 | Davis . | |
| 3,066,293 | 11/1962 | Davis | 343/767 |
| 3,210,766 | 10/1965 | Parker | 343/712 |
| 3,364,871 | 1/1968 | Maheux | 343/702 |
| 3,611,388 | 10/1971 | Okumura | 343/712 |
| 3,717,876 | 2/1973 | Volkers et al. | 343/712 |
| 3,728,732 | 4/1973 | Igarashi | 343/713 |
| 3,742,508 | 6/1973 | Tomaszewski | 343/713 |
| 3,794,997 | 2/1974 | Iwatsuki et al. | 343/712 |
| 3,823,403 | 7/1974 | Walter et al. | 343/708 |
| 3,916,413 | 10/1975 | Davis | 343/712 |
| 3,961,292 | 6/1976 | Davis | 343/712 |
| 3,961,330 | 6/1976 | Davis | 343/712 |
| 3,972,048 | 7/1976 | Davis | 343/711 |
| 4,003,056 | 1/1977 | Davis | 343/713 X |
| 4,080,603 | 3/1978 | Moody | 343/712 |
| 4,217,591 | 8/1980 | Czerwinski | 343/713 |
| 4,278,980 | 7/1981 | Ogita et al. | 343/748 |
| 4,317,121 | 2/1982 | Allen, Jr. et al. | 343/712 |
| 4,339,827 | 7/1982 | Torres et al. | 343/748 |
| 4,499,606 | 2/1985 | Rambo | 455/277 |
| 4,506,267 | 3/1985 | Harmuth | 343/744 |
| 4,566,133 | 1/1986 | Rambo | 455/277 |
| 4,633,519 | 12/1986 | Gotoh et al. | 455/277 |

Japanese Pat. Abstract, vol. 6, No. 37 E-97, Mar. 6, 1982, 56-156031.

Japanese Pat. Abstract, vol. 6, No. 55 E-101 4/10/82, 56-168441.

Japanese Pat. Abstract, vol. 7, No. E-187 7/15/83, 58-70640.

Japanese Pat. Abstract, vol. 7, No. 162 E-187, 7/15/83, 58-70642.

AUTOMOBILE ANTENNA SYSTEM

BACKGROUND OF THE INVENTION

1. Field of the Invention

The present invention relates to an improved automobile antenna system for efficiently detecting radio waves received at the vehicle body and transmitting detected signals to various built-in receivers.

2. Description of the Prior Art

Antenna systems are essential for modern automobiles to positively receive various waves such as radio waves, TV waves, car-telephone waves and others at built-in receivers in the vehicle bodies. Antenna systems also are very important for transmission and reception of waves in citizen band tranceivers.

There is generally known a pole type antenna which projects outwardly from the vehicle body. The pole type antenna exhibits a preferred performance receiving broadcast waves, but always provide an obstruction on the vehicle body design.

The pole type antenna also is subject to being damaged or stolen and further produces an unpleasant noise when an automobile on which the pole type antenna is mounted runs at high speeds.

Recently, the range of bands to which broadcast or communication waves belong is being increased. In such an event, the number of antennas must be correspondingly increased. This counteracts the aesthetic concepts in automobile design and also raises a problem in that electrical interference between the antennas remarkably degrades performance.

Some attempts have been made to eliminate or conceal the pole type antenna. One such attempt is that an antenna wire is applied to the rear window glass in an automobile.

There has also been made a proposal in which an antenna system is adapted to detect surface currents induced on the vehicle body by radio waves. Although this proposal is apparently positive and efficient, experiments showed that it could not effectively be used.

One reason why surface currents induced on the vehicle body by radio waves could not efficiently be utilized in the prior art is that the level of the induced surface currents is not as high as expected. The prior art utilized surface currents induced on the roof panel of the vehicle body. Notwithstanding, the outputs of sufficient level to be utilized could not be detected.

A second reason is that a very increased amount of noise is included in the surface currents on the vehicle body. The noise mainly results from the operation of ignition and regulator systems in an engine. The noise cannot be eliminated unless the engine is stopped.

One proposal for overcoming such problems in the prior art is disclosed in Japanese Patent Publication No. Sho 53-22418 in which electrical insulation is formed on the vehicle body at a location on which surface currents concentrate. Surface currents between the opposite ends of the insulation are detected directly by a sensor. Although this proposal can detect practicable signals which are superior in S/N ratio, it requires a pick-up which must be mounted in a notch formed in a portion of the vehicle body. This is not acceptable in mass-production.

Another proposal is disclosed in Japanese Utility Model Publication No. Sho 53-34826 in which an antenna system includes a pick-up coil used to detect surface currents flowing on a pillar in the vehicle body.

However, the pick-up coil must be located adjacent to the pillar in a direction perpendicular to the length thereof. Such an arrangement is not practical and further does not provide practicable antenna outputs.

In the prior art, moreover, the resonance frequency of the antenna itself is fixed. When reception is to be carried out over wider bands of frequency, therefore, a plurality of antenna units are required.

Furthermore, the prior art antenna system is increased in size with an associated impedance matching circuit and pre-amplifier also being enlarged. This limits the location at which the antenna system is desirably located on the vehicle body.

SUMMARY OF THE INVENTION

It is therefore an object of the present invention to provide an antenna system suitable for use in small-sized automobiles, which has a wide band characteristic and can efficiently detect currents induced on the vehicle body by radio waves with the detected signals being transmitted to a built-in receiver in the vehicle body.

To accomplish the above object, the present invention provides an antenna system comprising a high-frequency pick-up located on the vehicle body in close proximity to the marginal edge thereof to detect the surface high-frequency currents having a desired frequency. The high-frequency pick-up is electrically connected with a varactor diode controlled on the side of a receiver such that the resonance frequency of the antenna will coincide with a tuned frequency selected by the receiver.

From the background of the times, the prior art antenna systems mainly intended to receive AM radio waves. Accordingly, antenna systems of such a type as to detect surface currents on the vehicle body could not provide a good characteristic of reception since the wavelength of AM radio waves is too large. The inventors aimed at this dependency of frequency and have found that the reception of surface currents on the vehicle body could very effectively be attained by limiting radio waves to be received in accordance with the principle of the present invention to radio waves belonging to frequency bands above FM frequency bands (normally, above 50 MHz).

The inventors also aimed at the fact that surface currents having such higher frequency were distributed over the vehicle body in very different levels. Therefore, the present invention is characterized in that the high-frequency pick-up is located at a location at which the density of currents induced by radio waves is higher. In accordance with the present invention, such a satisfactory location is adjacent to the marginal edge of the vehicle body.

The present invention is characterized also in that the high-frequency pick-up includes a varactor diode for optionally adjusting the resonance frequency of the antenna to match a tuned frequency required by the receiver. The capacity of the varactor diode is varied depending on the level of the tuned frequency in the receiver to provide a desired frequency characteristic.

The present invention is further characterized in that the high-frequency pick-up is connected with a varactor diode for receiving FM radio waves, a varactor diode for receiving VHFTV waves and a varactor diode for receiving UHFTV waves. The capacity of the varactor diode corresponding to a broadcast wave selected by the receiver is varied so that the resonance frequency of the antenna system will coincide with the frequency of the broadcast wave selected by the receiver. Thus, the antenna system can receive broadcast waves belonging to wide bands including FM waves, VHFTV waves and UHFTV waves without reception of waves belonging to frequency bands in which normal broadcast waves are absent.

The present invention is further characterized in that feeble signals detected by the high-frequency pick-up are pre-processed by an impedance matching circuit and a high-frequency amplifier circuit which are located within the pick-up. The pre-processed signals are then transmitted to the receiver through a coaxial antenna cable. In accordance with the present invention, the antenna system can be miniaturized by incorporating the pre-circuits into the pick-up.

DESCRIPTION OF PREFERRED EMBODIMENTS

The present invention will now be described by way of example with reference to the drawings.

Figure 19:
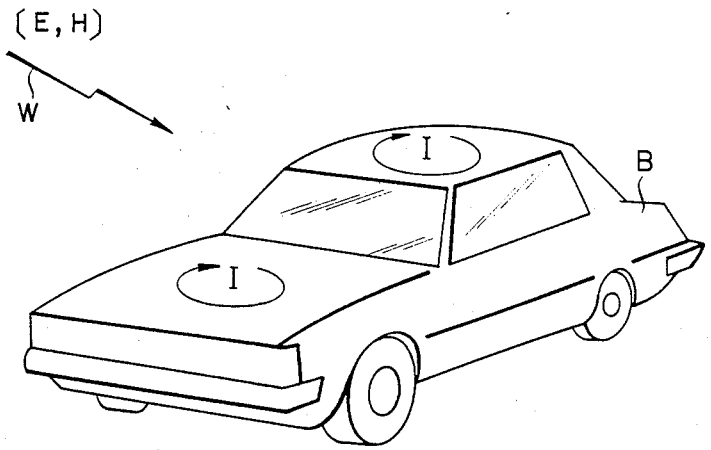
FIG. 19 illustrates surface currents I induced on the vehicle body B by external waves W.

FIG. 19 shows that when external waves W such as radio waves and the like pass through a vehicle body B of electrically conductive metal, surface currents I having an intensity corresponding to that of the external waves are induced on the vehicle body at its various locations. The present invention intends to utilize a portion of the external waves which belong to relatively high frequency bands having frequencies above 50 MHz, such as FM wave bands, TV wave bands and others.

The present invention is characterized in that for the above high-frequency bands, a pick-up device is located on the vehicle body at a location where the density of induced surface currents is higher with less noise.

To determine a distribution of surface currents, a simulation is made by using a computer and also the actual intensity of the surface currents is measured at various vehicle locations. The present invention utilizes a probe to measure the intensity of surface currents on the vehicle body. The probe is constructed and functions in accordance with the same principle as that of a high-frequency pick-up device which is to be located on the vehicle body at a desired location as will be described. The probe is moved through the entire surface of the vehicle body with its orientation being changed at the respective locations to measure the surface currents.

Figure 20:
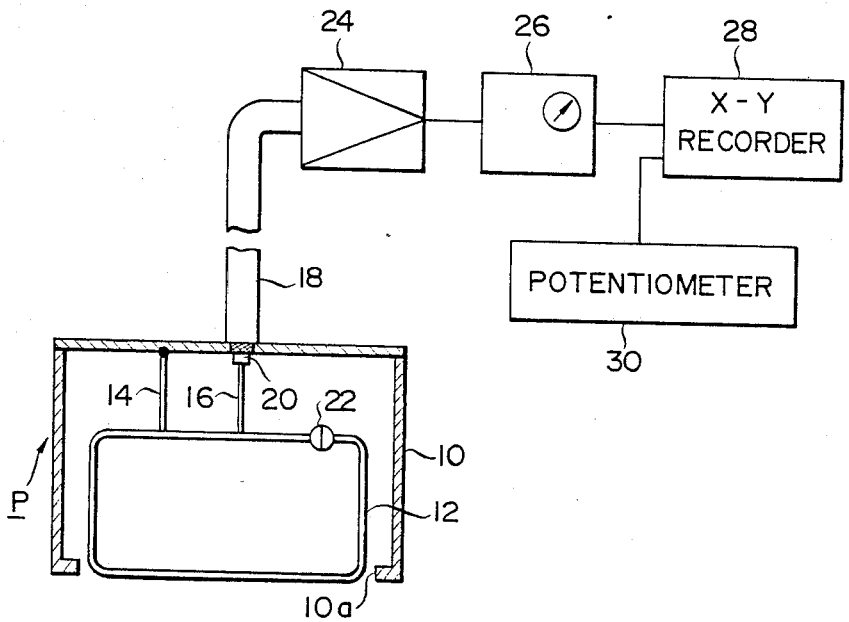
FIG. 20 illustrates the process of determining a distribution of surface currents on the vehicle body using a probe constructed and functioning in accordance with the same principle as that of the high-frequency pick-up devices of the present invention with a processing circuit used therein.

FIG. 20 shows such a probe P which comprises a casing 10 of electrically conductive material and a loop coil 12 located within the casing 10 so that the loop coil 12 will be protected from any undesirable external waves. The casing 10 is provided with an opening 10*a* through which a portion of the loop coil 12 is externally exposed. The exposed portion of the loop coil 12 is positioned in close proximity to the surface of the vehicle body B to detect a magnetic flux formed by surface currents which are induced on the vehicle body by external waves. The loop coil 12 is electrically connected with the casing 10 through a short-circuiting line 14. The output terminal 16 of the loop coil 12 is electrically connected with a conductive core 20 in a coaxial cable 18. The loop coil 12 also includes a capacitor 22 for causing the frequency of the loop coil 12 to resonate with a desired frequency to be measured. As a result, the efficiency of the pick-up device can be increased.

When such a probe P is moved along the surface of the vehicle body B and angularly rotated at the respective measurement points, the distribution and orientation of the surface currents induced on the vehicle body can accurately be determined.

Referring again to FIG. 20, the output of the probe P is amplified by a high-frequency voltage amplifier 24. The amplified output voltages are then measured by means of a high-frequency voltage measuring device 26. These output voltages from the loop coil 12 are also recorded by means of an X-Y recorder 28 as values of surface currents on the vehicle body at various locations. The input of the X-Y recorder 28 also receives signals from a potentiometer 30, which signals are indicative of the respective locations on the vehicle body. As a result, one can know a level of surface high-frequency currents at each of the locations on the vehicle body.

Referring now to FIGS. 1 to 4, there is shown a first embodiment of the present invention in which a high-frequency pick-up device 38 is mounted on a roof panel 32 at a location adjacent to its rearward edge.

Figure 2:
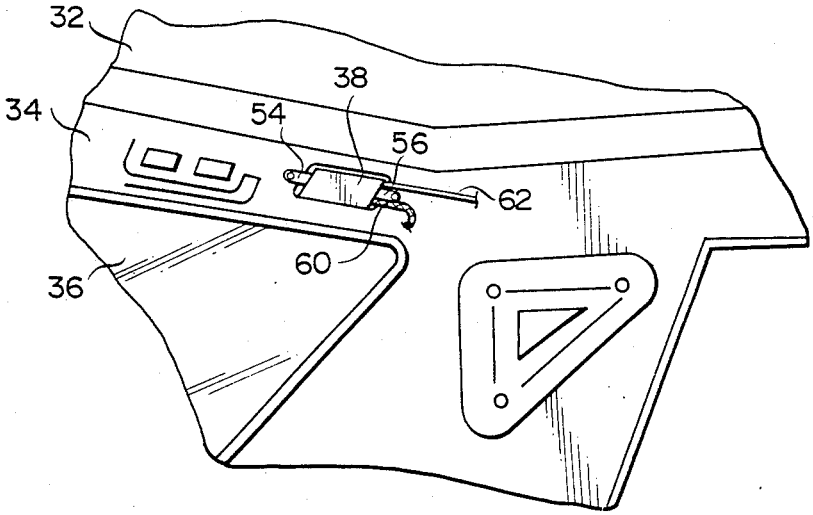
FIG. 2 is a perspective view of a first preferred embodiment of an automobile antenna system constructed according to the present invention, showing its electromagnetic coupling type high-frequency pick-up being mounted on a rear window frame on the vehicle roof panel.

In FIG. 2, the roof panel 32 is shown to be exposed. The roof panel 32 is made of a metal material and has its marginal portion forming a rear window frame 34 which is connected with a rear window glass 36. This illustrated embodiment is characterized in that the high-frequency pick-up device 38 is spaced from the outer margin of the rear window frame 34 within a range of $l=12\times 13\ \lambda(m)$ where $\lambda$ is the wavelengh of a telegraph frequency measured in metric units.

Figure 1:
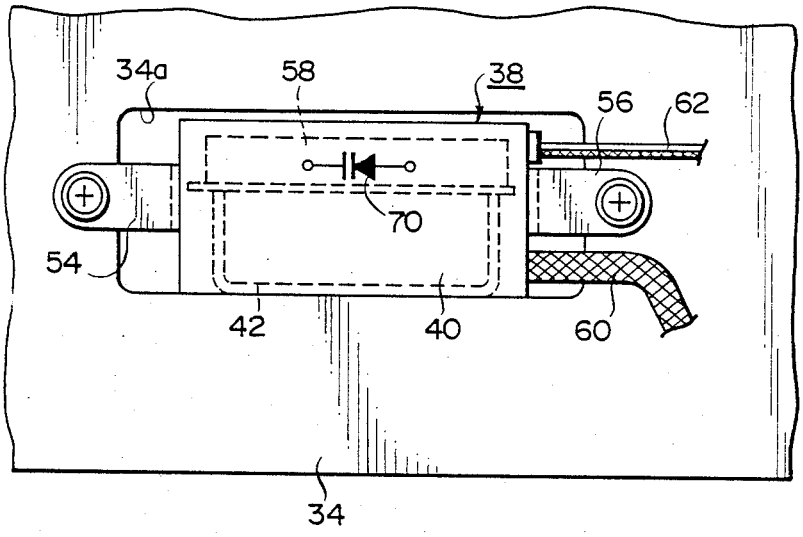
FIG. 1 is a plan view showing the details of the mounting of a high-frequency pick-up shown in FIG. 2.

As can be best seen from FIG. 1, the high-frequency pick-up device 38 comprises a casing 40 of a metal material for shielding any external magnetic flux and a loop antenna 42 located within the casing 40. The pick-up device 38 forms an electromagnetic coupling type pick-up device having a structure similar to that of the aforementioned probe used to measure the distribution of surface currents on the vehicle body.

Figure 3:
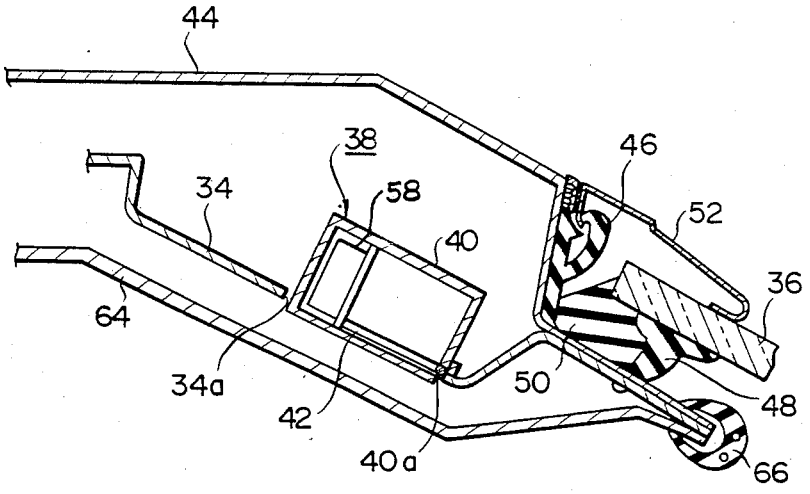
FIG. 3 is a cross-sectional view of the primary parts of the first embodiment.

FIG. 3 shows the cross-section of the portion of the roof panel 32 in which the high-frequency pick-up device 38 of the present invention is mounted. The roof panel 32 includes a roof panel portion 44 on the end of which the rear window frame 34 is fixedly mounted. The roof panel portion 44 supports the rear window glass 36 through fastener means 46 and dam means 48 which are air-tightly adhered to each other by adhesive material 50. A molding 52 is mounted between the roof panel portion 44 and the rear window glass 36.

The loop antenna 42 of the high-frequency pick-up device 38 is positioned in close proximity to the marginal edge of the rear window frame 34 by locating the casing 40 in an opening **34*a* formed in the rear window frame 34**.

As can be best seen from FIG. 3, the casing 40 is provided with an opening **40*a* through which one of the longitudinal sides of the loop antenna 42 is externally exposed and positioned in close proximity to the opening edge of the rear window frame 34. Thus, a magnetic flux formed by surface high-frequency currents flowing on the marginal edge of the rear window frame 34 can positively be caught by the loop antenna 42 in the casing 40. On the contrary, the other external magnetic fluxes can positively be blocked by the shielding casing 40. In this manner, surface currents induced on the vehicle body can efficiently be detected by the high-frequency pick-up device 38**.

Figure 4:
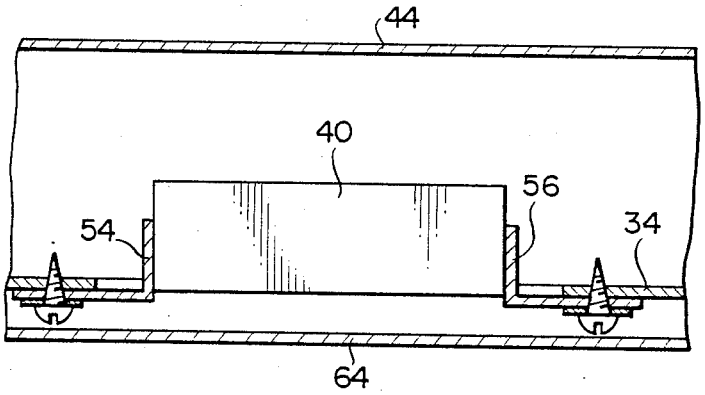
FIG. 4 is a cross-sectional view, as viewed from the other direction, of the primary parts in the high-frequency pick-up in the first embodiment.

To positively position the casing 40 of the high-frequency pick-up device 38 relative to the rear window frame 34, as shown in FIG. 4, L-shaped brackets 54 and 56 are respectively connected with the opposite ends of the casing 40 by any suitable fastening means such as bolts or the like. Each of the brackets 54 and 56 is fastened to the rear window frame 34 by screws.

The casing 40 of the high-frequency pick-up device 38 contains circuitry 58 connected with the loop antenna 42. The circuitry 58 includes various circuits for processing detected signals, such as a matching circuit, pre-amplifier and others. The detected signals of high frequency are fetched externally through a coaxial cable 60 and then transmitted to various built-in receivers such as radio receivers, TV receivers and others. The circuitry 58 receives power and control signals through a cable 62.

The loop antenna 42 is in the form of a single-winding antenna which is covered with an insulating coating such that the antenna can electrically be insulated from and located in close contact with the rear window frame 34. Thus, the magnetic flux formed by the surface currents can more efficiently intersect the loop antenna 42.

After the high-frequency pick-up device 38 has been mounted on the roof panel 32 and particularly the rear window frame 34, a roof garnish 64 is mounted on the roof panel. An edge molding 66 is then mounted between the roof garnish 64 and the rear window frame 34.

In the illustrated embodiment, the exposed portion of the loop antenna 42 through the casing 40 is spaced from the marginal edge of the rear window frame 34 within a range represented by $l=12\times 10^{-3}\lambda(m)$. Consequently, waves belonging, for example, to the FM radio band having a frequency of 80 MHz can positively be detected from the surface currents flowing on the vehicle body at the marginal portion of the rear window frame 34. Since the orientation of the flowing currents is along the marginal portion of the rear window frame 34, the longitudinal side of the loop antenna 46 is disposed parallel to the marginal edge of the rear window frame 34.

The first embodiment of the present invention provides a very superior automobile antenna system capable of positively receiving waves of higher frequency bands without need of any externally projecting portion since its high-frequency pick-up device electromagnetically detects the surface currents flowing on the marginal portion of the vehicle body and particularly the marginal portion of the roof panel.

The present invention is further characterized in that the aforementioned circuitry 58 includes a varactor diode 70 for permitting the resonance frequency of the high-frequency pick-up device including the loop antenna 42 to regulate optionally. As will be apparent, the antenna system of the present invention is controlled such that the resonance frequency of the high-frequency pick-up device 38 is matched to the tuned frequency of a built-in receiver by selecting the capacity level of the varactor diode 70 under the influence of the above tuned frequency of the built-in receiver.

Figure 5:
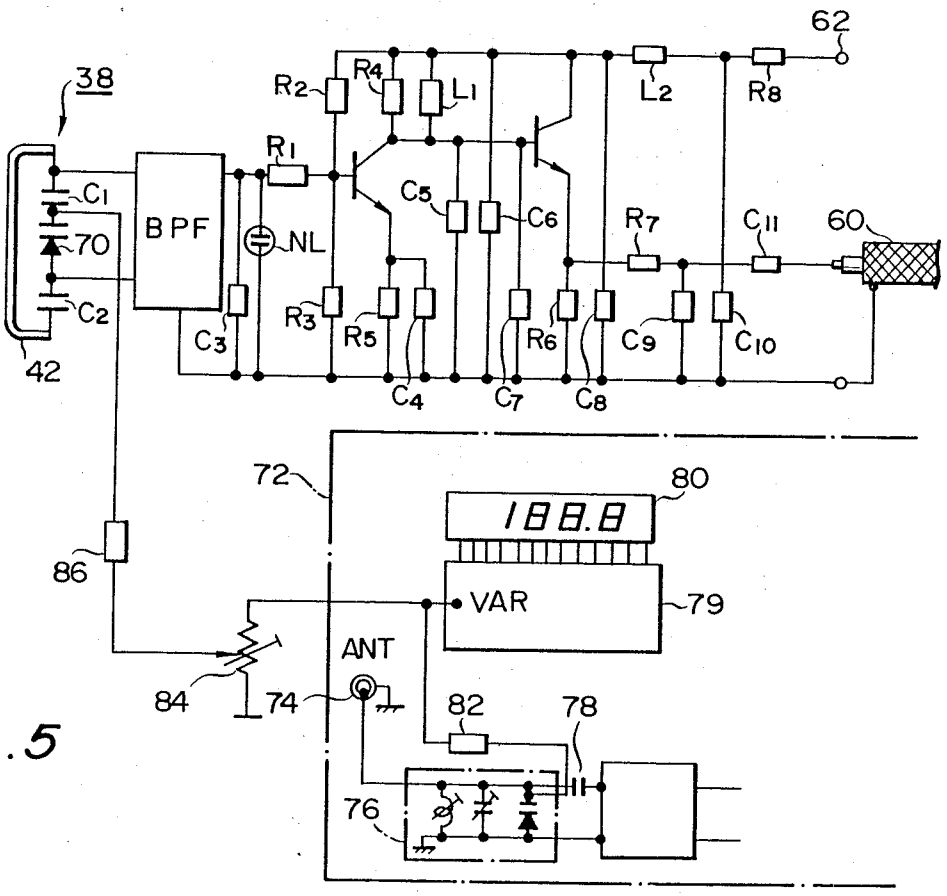
FIG. 5 is a circuit diagram of the electromagnetic coupling type high-frequency pick-up shown in FIG. 2 with a portion of a receiver.

FIG. 5 is a circuit diagram showing a state in which the loop antenna 42 of the electromagnetic coupling type high-frequency pick-up device 38 in the first embodiment shown in FIGS. 1 to 4 is electrically connected with said varactor diode 70 and a pre-amplifier and also in which the varactor diode 70 is electrically connected with the built-in receiver.

In FIG. 5, the loop antenna 42 is electrically connected in series with a capacitor C1, the varactor diode 70 and a capacitor C2 with its resonance frequency being determined by the series capacity of these components. The output of the high-frequency pick-up device 38 is obtained from one end of the capacitor C1 and also the anode terminal of the varactor diode 70. With respect to the obtained output of the pick-up device 38, the desired impedance conversion and high-frequency amplification are carried out by the pre-amplifier located adjacent to the pick-up device 38 as said circuitry 58. As shown, the pre-amplifier includes a band pass filter BPF which can select only a desired frequency band and eliminate other signals including noise signals. The detected and amplified signals are then subjected to an impedance conversion at an impedance converting circuit comprising resistors and capacitors. The signals are further amplified with respect to frequency and then supplied to the built-in receiver through the coaxial cable 60. These components including the pre-amplifier are supplied with power voltage through the cable 62.

The level of the detected signals in the pre-amplifier is thus maximum at the resonance frequency of the high-frequency pick-up device 38. This resonance frequency can be matched to a desired frequency to be received by changing the capacity of the varactor diode 70. Therefore, the antenna system can be reduced in size and yet efficiently receive waves. In the illustrated embodiment, the pre-amplifier also includes a neon tube NL functioning to protect semiconductor elements from high voltages due to lightning and static electricity.

The capacity of the varactor diode 70 may be changed when a predetermined control voltage is applied to the cathode side of the varactor diode 70, the applied control voltage being controlled in association with the tuned frequency of the built-in receiver.

Referring to FIG. 5, there is shown part of a built-in receiver 22 in which the other end of said coaxial cable 60 is electrically connected with the antenna terminal 74 of the receiver 72. The antenna terminal 74 is then connected with the subsequent receiving circuit through a tuning circuit 76 and capacitor 78. The tuning circuit 76 is adapted to select any tuned frequency by changing the inductance of the coil or the capacity of the capacitor. In the illustrated embodiment, such a selected frequency is controlled and selected by a tuned-frequency control circuit 79 and also displayed at a display 80.

The present embodiment is characterized in that the tuned-frequency control voltage from the tuned-frequency control circuit 79 in the receiver 72 is supplied to the cathode side of the varactor diode 70 through a variable resistor 84 and a resistor 86. In such a manner, the varactor diode 70 will receive a control voltage corresponding to the tuned frequency selected by the tuning circuit 76.

When a desired frequency to be received is selected at the receiver 72, the resonance frequency of the pick-up device 38 is varied to match to said tuned frequency. Therefore, the small-sized antenna system constructed in accordance with the present invention can efficiently receive waves.

Figure 6:
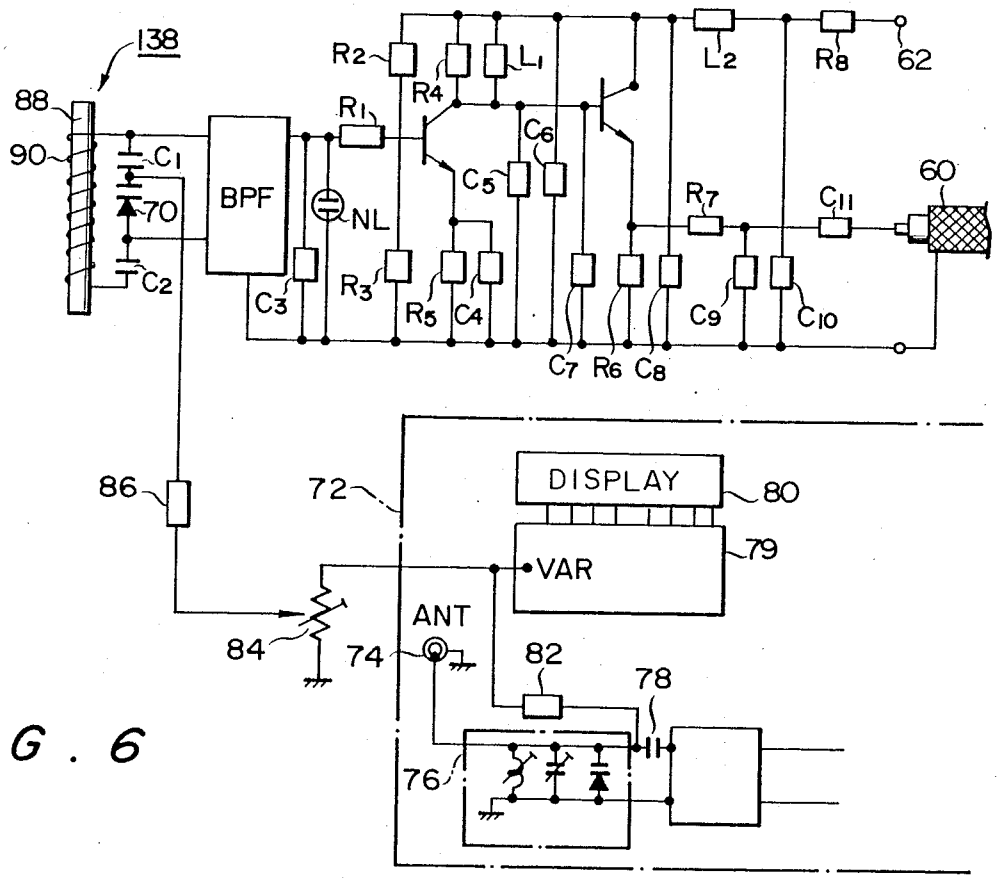
FIG. 6 is a circuit diagram showing a circuitry according to the present invention connected with an electromagnetic coupling type pick-up including a ferrite core.

The present invention may utilize a high-frequency pick-up device other than the loop antenna of the single-winding type. For example, a high-frequency pick-up device comprising a ferrite core and an antenna coil wound about the core may similarly be used to detect surface currents. FIG. 6 shows a high-frequency pick-up device 138 comprising a ferrite core 88 and a pick-up coil 90 wound about the ferrite core 88. This ferrite core type high-frequency pick-up device 138 is disposed parallel to the marginal edge of the vehicle body to detect surface currents on the vehicle body.

In the embodiment of FIG. 6, the varactor diode 70 also is connected with the coil 90. The control voltage of the varactor diode 70 is changed by the tuning signal from the receiver 72. Thus, the resonance frequency of the high-frequency pick-up device 138 will be matched to a tuned frequency selected at the receiver 72.

Figure 7:
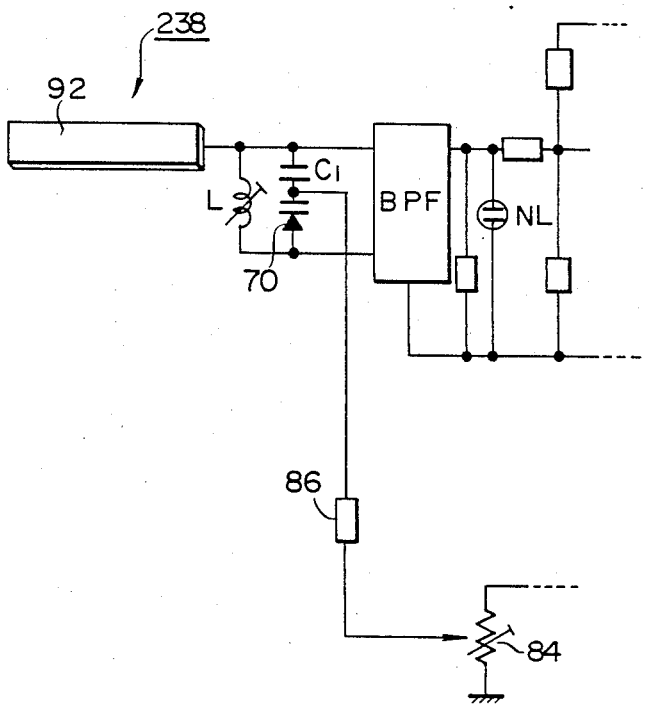
FIG. 7 is a circuit diagram showing the primary parts of an electrostatic coupling type pick-up connected with a varactor diode.

Moreover, the present invention may similarly be applied to an electrostatic coupling type high-frequency pick-up device. Referring to FIG. 7, there is shown an electrostatic coupling type high-frequency pick-up device 238 comprising a detecting electrode 92 which is disposed parallel and in close proximity to the marginal edge of the vehicle body to efficiently detect surface currents on the vehicle body. The embodiment shown in FIG. 7 also includes a tuning circuit connecting the varactor diode 70 with the detecting electrode 92. This tuning circuit is similarly controlled by the tuned frequency from the receiver to regulate the resonance frequency of the pick-up device.

Figure 8:
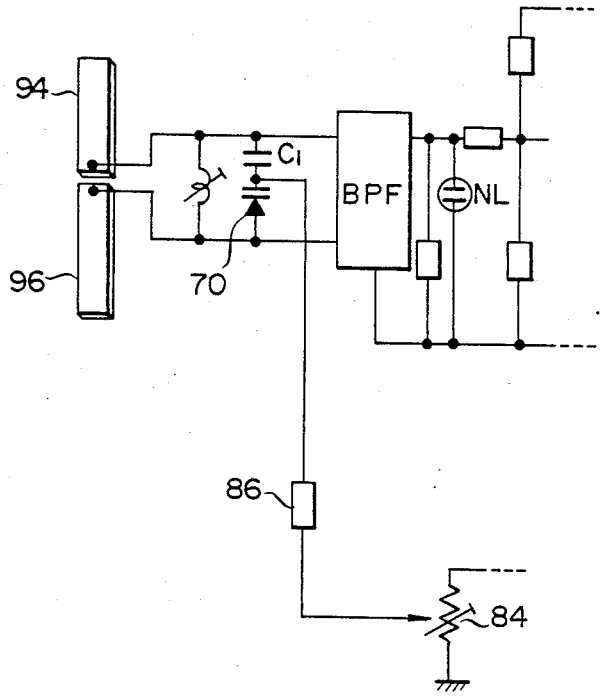
FIG. 8 is a circuit diagram showing the primary parts of an electrostatic coupling type high-frequency pick-up which includes two detecting electrodes and is connected with a varactor diode.

FIG. 8 shows another form of the electrostatic coupling type pick-up device, which comprises a pair of detecting electrodes 94 and 96 adapted to be located on the vehicle body at a given marginal location. Similarly, the resonance frequency of the high-frequency pick-up device may be controlled by the varactor diode 70 to match to the tuned frequency of the receiver.

Figure 9:
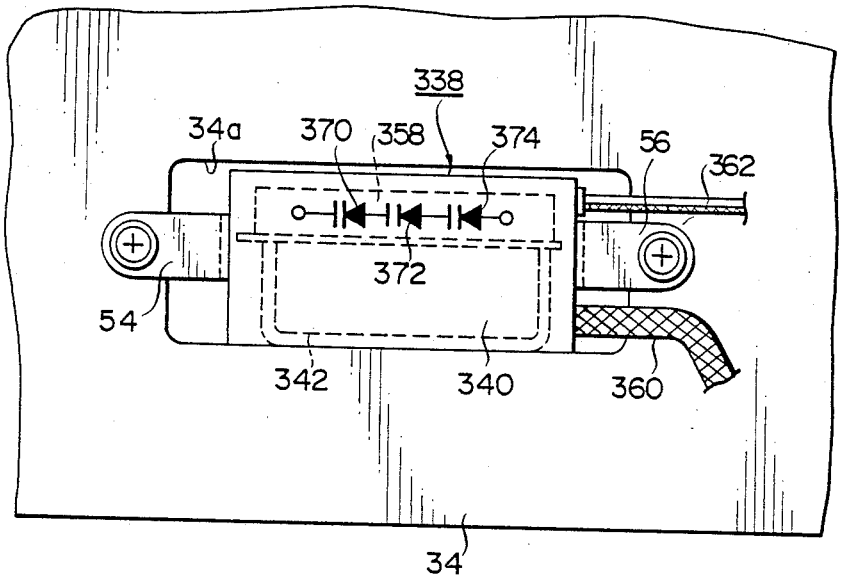
FIG. 9 is a plan view of a second embodiment of an antenna system constructed according to the present invention in which a high-frequency pick-up comprises a plurality of varactor diodes connected parallel with one another.

Referring to FIG. 9, there is shown a further embodiment of the high-frequency pick-up device used in the automobile antenna system according to the present invention.

The embodiment of FIG. 9 is characterized in that a loop antenna 342 is electrically connected in series with a varactor diode 370 for receiving FM waves, a varactor diode 372 for receiving VHFTV waves and a varactor diode 374 for receiving UHFTV waves which are also connected in series with each other in circuitry 358. One of these varactor diodes 370, 372 and 374 is selected and controlled by a tuned frequency from a built-in receiver, which will be described, such that the resonance frequency of the high-frequency pick-up device will be matched to the tuned frequency of the receiver.

Figure 10:
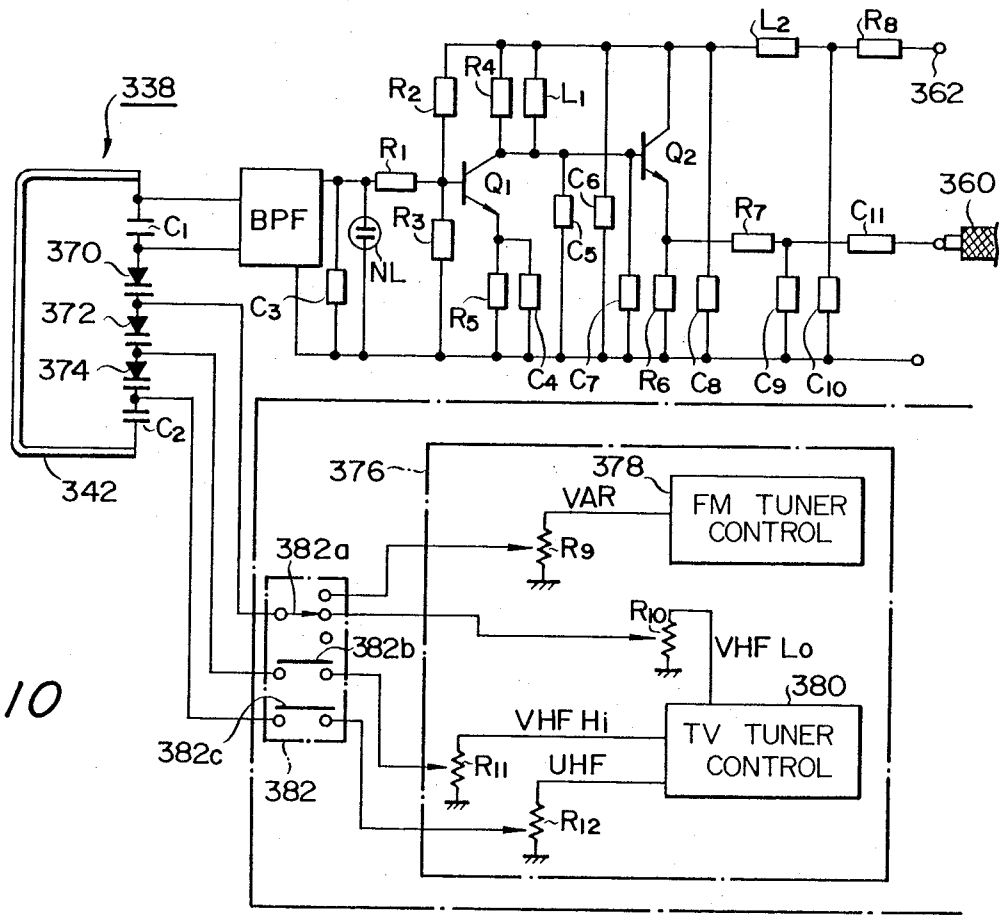
FIG. 10 is a circuit diagram showing a preferred circuit for the electromagnetic coupling type high-frequency pick-up shown in FIG. 9 with a portion of the receiver.

FIG. 10 shows a circuit wherein the loop antenna 342 of the electromagnetic coupling type high-frequency pick-up device 338 shown in FIG. 9 is electrically connected with the above three diodes 370, 372 and 374 and a pre-amplifier and wherein the three varactor diodes 370, 372 and 374 are electrically connected with the receiver.

As seen from FIG. 10, the loop antenna 342 is electrically connected in series with a capacitor C1, three series-connected varactor diodes 370, 372 and 374 for respectively receiving FM, VHFTV and UHFTV waves, and a capacitor C2. Thus, the loop antenna 342 will have a resonance frequency which is determined from the series capacity level of the varactor diodes and capacitors C1, C2 to which a control voltage is applied. The output of the high-frequency pick-up device 338 is fetched from the opposite ends of the capacitor C1 and then subjected to the desired impedance conversion and high-frequency amplification at a pre-amplifier which is located near the pick-up device 338 as the aforementioned circuitry 358. As shown, the pre-amplifier includes a band pass filter BPF which can select a desired frequency band and eliminate other signals including noise. The high-frequency signals so detected and amplified are then subjected to an impedance conversion and a further high-frequency amplification at an impedance converting circuit which comprises resistors and capacitors. Thereafter, these signals are supplied to the receiver through a coaxial cable 360. The pre-amplifier receives a power voltage through a cable 362.

A predetermined control voltage is selectively applied to each of the varactor diodes 370, 372 and 374 at its cathode side to vary the capacity thereof. The applied voltage is controlled in association with the tuned frequency of the receiver.

FIG. 10 shows part of the receiver which includes an antenna terminal electrically connected with the other end of the coaxial cable 360. The antenna terminal is electrically connected with the subsequent receiving circuit through a tuning circuit 376. The primary part of the tuning circuit 376 comprises a FM tuner control micro-computer 378 generating FM tuning control output voltages used to receive FM radio waves (76–90 MHz) and a TV tuner control micro-computer 380 producing VHF Lo tuning control output voltages used to receive VHFTV waves having lower frequencies (90–108 MHz), VHF Hi tuning control output voltages used to receive VHFTV waves having higher frequencies (170–220 MHz) and UHF tuning control output voltages used to receive UHFTV waves.

The FM tuning control voltages, VHF Lo tuning control voltages, VHF Hi tuning control voltages and UHF tuning control voltages are adjusted respectively by variable resistors R9, R10, R11 and R12. By actuating switch means 382 in the receiver, a control voltage will be applied to the cathode side of each of the varactor diodes 370, 372 and 374.

When a switch **382*a* in the switch means 382 is shifted to the upper contact, an FM tuning control voltage is applied to the varactor diode 370 for receiving FM radio waves. When the switch 382*a* is shifted to the lower contact, a VHF Lo tuning control voltage is applied to the varactor diode 70**.

When a switch **382*b* is closed, a VHF Hi tuning control voltage is applied to the varactor diode 372 for receiving VHFTV waves. When a switch 382*c* is closed, a UHF tuning control voltage is applied to the varactor diode 374** for receiving UHFTV waves.

If the loop antenna 342 has dimensions of about 2 cm×5 cm, its self-inductance L is equal to about 50 μH. Therefore, the range of change in the capacity of each of the varactor diodes 370, 372 and 374 is as follows.

The varactor diode 370 for receiving FM waves: FM - VHF Lo (1 ch.–3 ch.) 80 pF–43 pF;

The varactor diode 372 for receiving VHFTV waves: VHF Hi (4 ch.–12 ch.) 17 pF–10 pF; and The varactor diode 374 for receiving UHFTV waves: UHF (13 ch.–52 ch.) 2.3 pF–0.8 pF.

For each of the frequency bands, the capacity of the corresponding one of the varactor diodes 370, 372 and 374 is thus changed by the tuning control voltage from the corresponding one of the FM and TV tuner control micro-computers 378 and 380. As a result, the resonance frequency of the antenna will coincide with any selected receiver frequency.

In such an arrangement, the single loop antenna 342 can efficiently receive waves belonging to broader frequency bands from FM bands to UHFTV bands since the frequency bands are separately selected.

Figure 11:
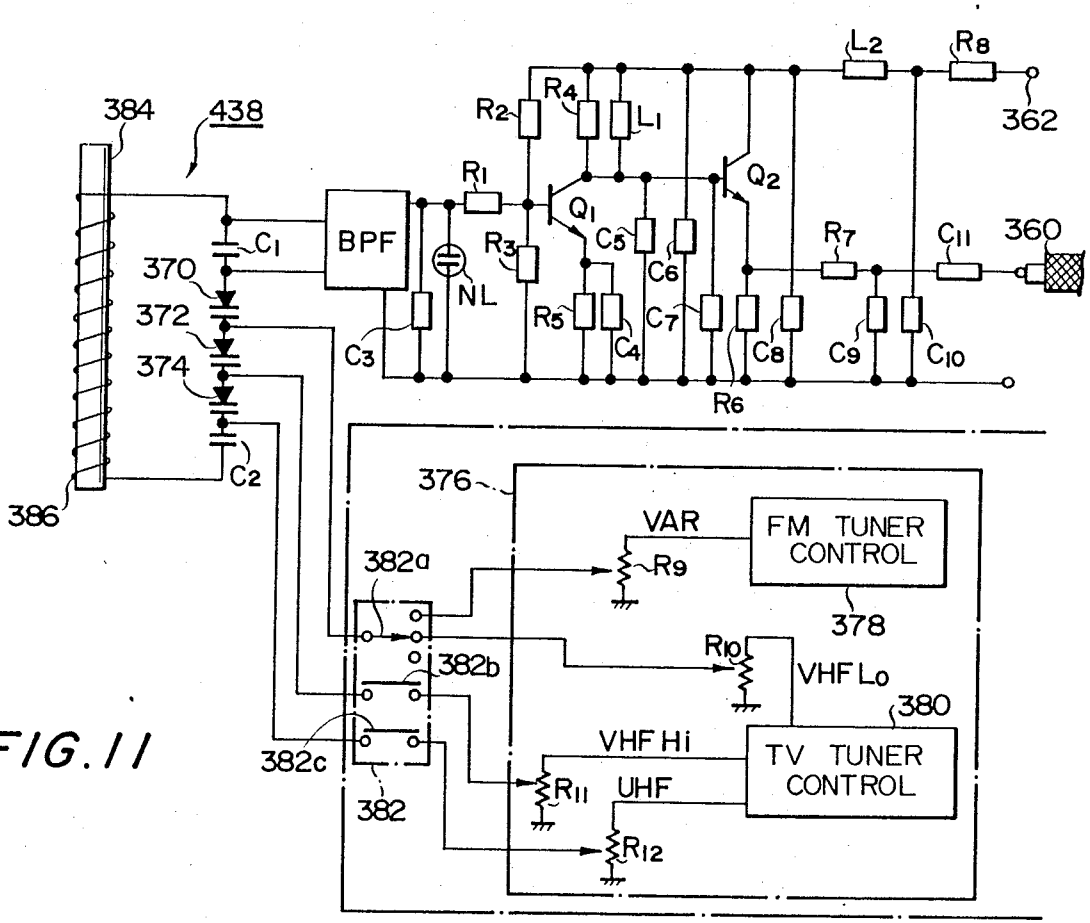
FIG. 11 is a circuit diagram showing a circuit according to the present invention connected with an electromagnetic coupling type pick-up including a ferrite core.

The present invention may similarly utilize another type high-frequency pick-up device which comprises a ferrite core and an antenna coil wound about the ferrite core. Referring to FIG. 11, there is shown a high-frequency pick-up device 438 comprising a ferrite core 384 and a pick-up coil 386 wound about the ferrite core 384. The high-frequency pick-up device 438 is disposed on the vehicle body parallel to the marginal edge thereof to detect surface currents induced on the surface of the vehicle body by external waves.

In the embodiment of FIG. 11, the coil 386 is connected with varactor diodes 370, 372 and 374. Similarly, the control voltage selectively applied to each of the varactor diodes 370, 372 and 374 is changed by the tuning signals from the receiver such that the resonance frequency of the high-frequency pick-up device 438 will coincide with a tuning frequency selected at the receiver.

Figure 12:
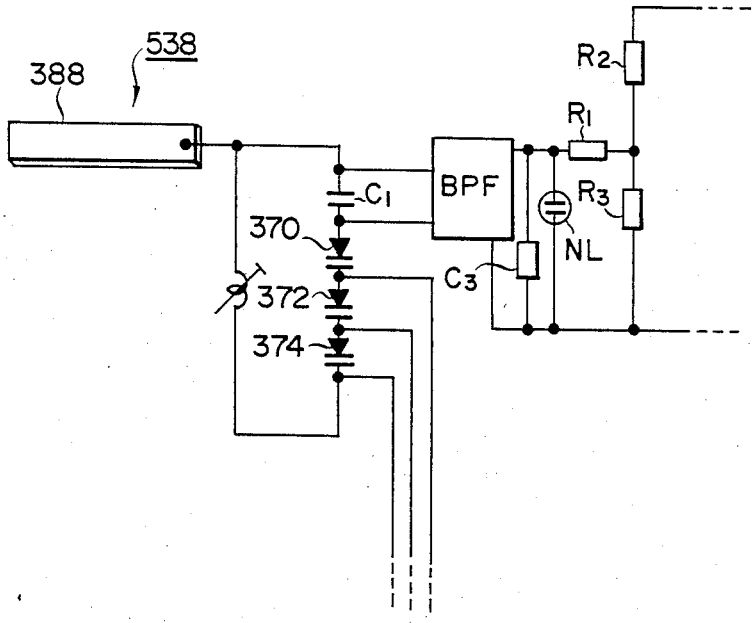
FIG. 12 is a circuit diagram showing the primary parts of an electrostatic coupling type pick-up connected with a varactor diode.

The present invention may similarly be applied to an electrostatic coupling type high-frequency pick-up device other than the aforementioned electromagnetic coupling type pick-up device. FIG. 12 shows an electrostatic coupling type high-frequency pick-up device 538 comprising a detecting electrode 388 which is positioned parallel and in close proximity to the marginal edge of the vehicle body. The embodiment shown in FIG. 12 includes a tuning circuit which connects the detecting electrode 388 with the varactor diodes 370, 372 and 374. When the tuning circuit is controlled by the tuning frequencies from the receiver, the resonance frequency of the electrostatic coupling type pick-up device can optionally be adjusted.

Figure 13:
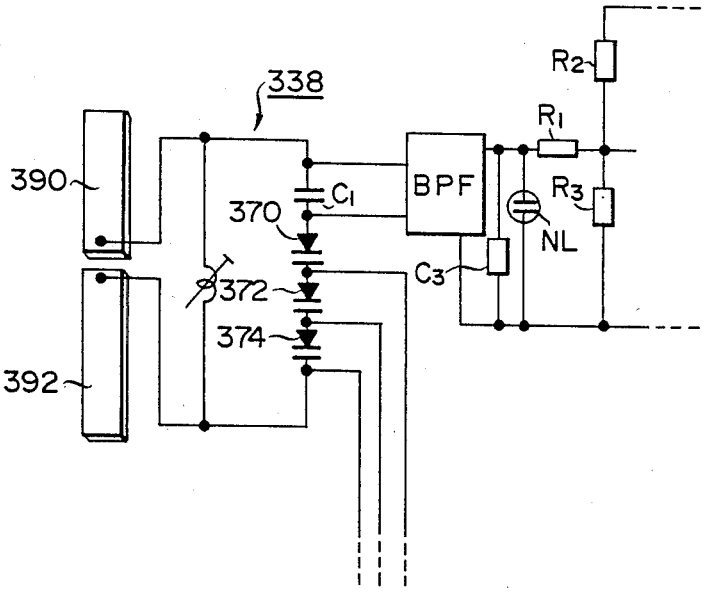
FIG. 13 is a circuit diagram showing the primary parts of an electrostatic coupling type high-frequency pick-up which includes two detecting electrodes and is connected with a varactor diode.

FIG. 13 shows another form of such an electrostatic coupling type pick-up device, which comprises a pair of detecting electrodes 390 and 392 located adjacent to the marginal portion of the vehicle body to detect surface currents thereon. Similarly, the resonance frequency of the high-frequency pick-up device can be controlled to be coincide with the selected tuning frequency of the receiver by operating varactor diodes 370, 372 and 374.

The embodiments illustrated in FIGS. 1 and 9 are characterized in that the circuitry (58; 358) including the impedance matching and amplifier circuits is contained within the casing (40; 340) of the high-frequency pick-up device (38; 338). The output impedance of the amplifier circuit is matched to the characteristic impedance of the coaxial antenna cable (60; 360). This results in a very efficient processing of signals. Such an arrangement is shown in FIG. 14.

Figure 14:
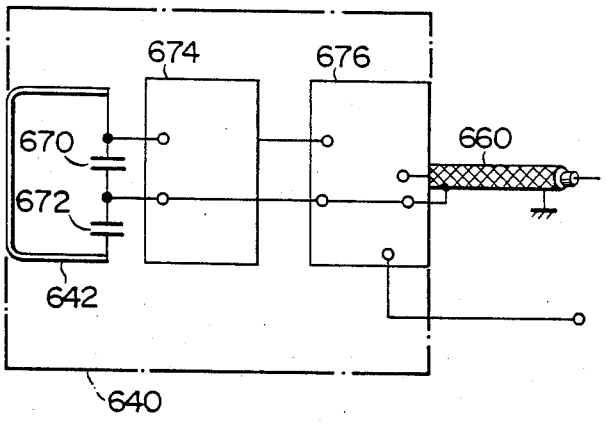
FIG. 14 is a circuit diagram schematically showing the high-frequency pick-up according to the present invention and a pre-circuit contained within a casing connected with the pick-up.

As seen from FIG. 14, a loop antenna 642 is electrically connected in series with capacitors 670 and 672. Detected signals fetched from the opposite ends of one of the capacitors 670 are subjected to an impedance matching at an impedance matching circuit 674 and further to a high-frequency amplification at the subsequent high-frequency amplifier circuit 676. The amplified signals are then supplied to a built-in receiver through a coaxial cable 660. As seen from FIG. 14, all of the loop antenna 642, impedance matching circuit 674 and high-frequency amplifying circuit 676 are housed within a casing 640. Feeble signals detected by the loop antenna 642 are suitably processed within the casing 640 and supplied to the receiver through the coaxial cable 660. Therefore, waves can efficiently be received by the receiver with less attenuation.

Figure 15:
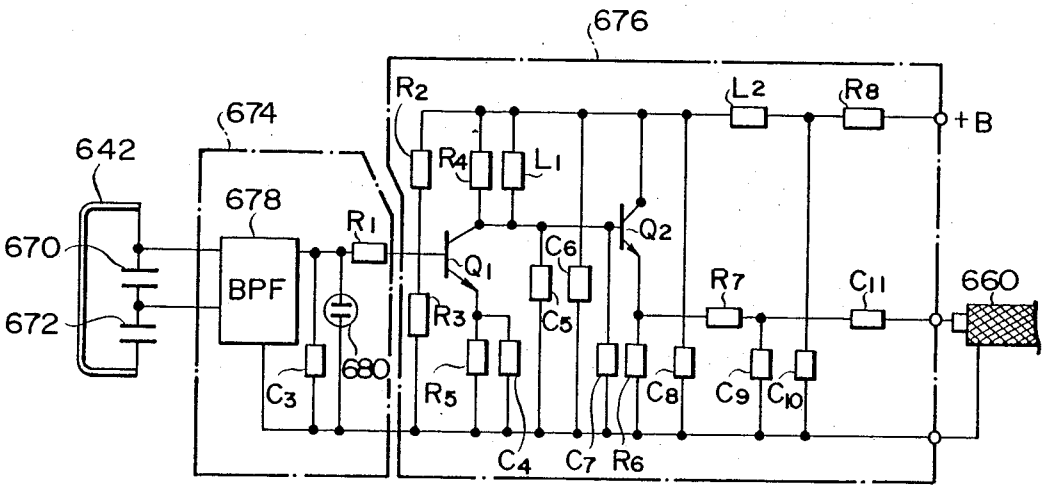
FIG. 15 is a circuit diagram showing a preferred circuit used in the electromagnetic coupling type high-frequency pick-up shown in FIG. 5.

FIG. 15 shows the details of the circuit shown in FIG. 14 which will be described below.

The impedance matching circuit 674 includes a band pass filter 678 and a discharge tube 680. Voltages detected by the loop antenna 642 and obtained through a capacitor 670 are supplied to the input of the band pass filter 678 with the output thereof being connected with a parallel circuit consisting of the discharge tube 680 and a capacitor C3.

The discharge tube 680 serves to protect the circuit from an external power due to static electricity, lightning and others. The band pass filter 678 causes the loop antenna 642 to be subjected to the impedance matching.

The signals subjected to the impedance matching are then subjected to a high-frequency amplification at the high-frequency amplifier circuit 676 which includes two-stage connected transistors Q1 and Q2 the output of which is connected with a receiver through a coaxial antenna cable 660.

The circuitry shown in FIG. 15 comprises inductances L1, L2 defining a peaking coil, resistors R2, R3 for stabilizing the operation of the transistor Q1, bias resistors R5, R6 and bypass capacitors C3, C9.

The conductive sheath of the coaxial cable 660 is grounded to define a grounding line for the impedance matching and high-frequency amplifying circuits 674 and 676 which are housed within the casing.

The output impedance of the high-frequency amplifying circuit 676 is set to coincide with the characteristic impedance of the coaxial antenna cable 660 so that a good matching between the high-frequency amplifying circuit 676 and the coaxial cable 660 will be obtained.

In accordance with the present invention, thus, feeble signals detected by the loop antenna 642 can be subjected to the desired impedance matching and high-frequency amplification in the casing which is a detecting location. These circuits themselves are miniaturized sufficiently to be housed within the casing 640. The signals obtained through the coaxial cable 660 can be highly stabilized and effectively supplied to the receiver.

Figure 16:
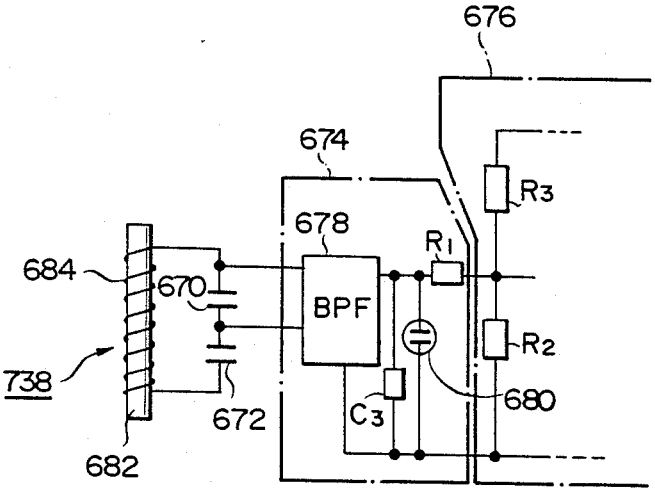
FIG. 16 is a circuit diagram showing a pre-circuit according to the present invention connected with an electromagnetic coupling type pick-up including a ferrite core.

The present invention may similarly utilize a high-frequency pick-up devide 738 as shown in FIG. 16. The pick-up device 738 comprises a ferrite coil 682 and a pick-up coil 684 wound about the ferrite core 682. The ferrite-core type pick-up device 738 is disposed parallel to the marginal edge of the vehicle body to detect desired surface currents on the surface of the vehicle body.

In the embodiment of FIG. 16, similarly, an impedance matching circuit 674 and a high-frequency amplifier circuit 676 are housed within a casing with the high-frequency pick-up device 738.

Figure 17:
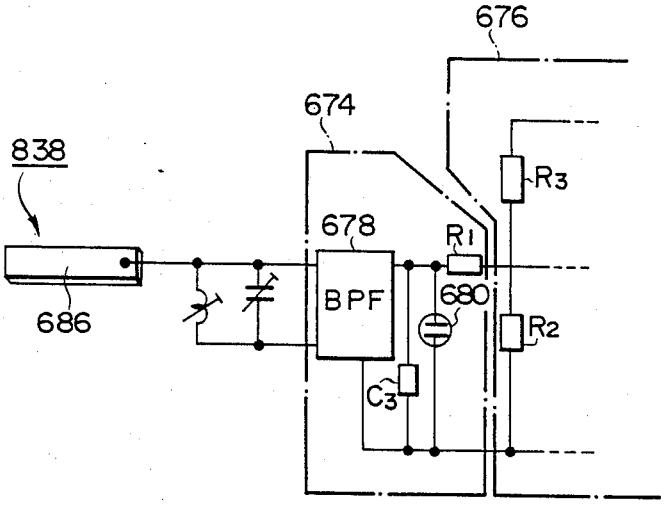
FIG. 17 is a circuit diagram showing a pre-circuit connected with an electrostatic coupling type pick-up.

The present invention may similarly be applied to an electrostatic coupling type high-frequency pick-up device 838 as shown in FIG. 17 which comprises a detecting electrode 686 disposed parallel and in close proximity to the marginal edge of the vehicle body. The embodiment of FIG. 17 also has a casing within which an impedance matching and high-frequency amplifying circuits 674 and 676 are housed together.

Figure 18:
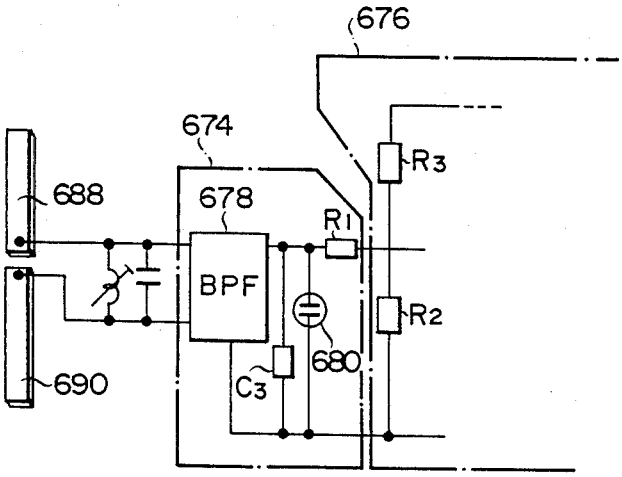
FIG. 18 is a circuit diagram showing a pre-circuit connected with an electrostatic coupling type high-frequency pick-up including two detecting electrodes.

FIG. 18 shows another form of the electrostatic coupling type pick-up device, which comprises a pair of detecting electrodes 688 and 690 disposed on the vehicle body at its marginal portion to detect surface currents. Similarly, signals are pre-processed by the impedance matching and high-frequency amplifying circuits 674 and 676 all of which are housed within a casing.

It will be apparent from the foregoing that for waves belonging to relatively high frequency bands such as above FM frequency bands, a radio wave receiving antenna is positioned on a given location and particularly the marginal edge portion of the vehicle body to detect surface high-frequency currents induced thereon and that the resonance frequency of the antenna is controlled to coincide with the tuned frequency of the receiver by the use of varactor diodes. Consequently, broadcast waves can efficiently be detected by the antenna with less noise and without any externally projecting portion.

In accordance with the present invention, furthermore, a wave receiving antenna is disposed on a given location and particularly the marginal portion of the vehicle body to detect surface high-frequency currents induced on the vehicle body by waves belonging to relatively high frequency bands such as above FM frequency bands. Impedance matching and high-frequency amplifying circuits defining a pre-circuit are housed together within the casing of a high-frequency pick-up device. Accordingly, the antenna system can be miniaturized and effectively detect the waves with less attenuation and without any externally exposed portion.

We claim:

1. An automobile antenna system which operates in conjunction with a built-in receiver in the vehicle body, said antenna system comprising:

high-frequency pick-up means for detecting surface high-frequency currents induced on the vehicle body by broadcast waves which flow concentratedly on a marginal portion of the vehicle body, said high-frequency pick-up means being disposed along and spaced apart from an outer marginal edge of the vehicle body at substantial $(12\times10^{-3})\lambda(m)$, where $\lambda$ is the wavelength of a broadcase wave to be received measured in metric units;

circuit means for processing a signal detected by said high-frequency pick-up means;

a casing housing said high-frequency pick-up means and said circuit means; and varactor diode means connected between said high-frequency pick-up means and said circuit means and being controlled by the built-in receiver for setting the resonance frequency of said antenna system to coincide with a tuned frequency selected by the built-in receiver.

2. An automobile antenna system as defined in claim 1 wherein said high-frequency pick-up means is located on the rear window frame of the vehicle body.

3. An automobile antnna system as defined in claim 1 wherein said high-frequency pick-up means comprises a loop antenna a portion of which is positioned in close proximity to the marginal edge portion of the vehicle body.

4. An automobile antenna system as defined in claim 3 wherein said loop antenna is connected in series with said varactor diode means and a capacitor with the series capacity thereof being used to determine the resonance frequency of said antenna system.

5. An automobile antenna system as defined in claim 4 wherein the control voltage associated with the tuned frequency of the built-in receiver is applied to the cathode side of said varactor diode means so that the resonance frequency of said antenna system will coincide with the tuned frequency of the built-in receiver.

6. An automobile antenna system as defined in claim 1 wherein said high-frequency pick-up means is an electrostatic coupling type high-frequency pick-up which comprises detecting electrode means disposed parallel and in close proximity to the marginal edge portion of the vehicle body.

7. An automobile antenna system as defined in claim 1, said varactor diode means comprising a plurality of varactor diodes electrically connected with said high-frequency pick-up means for selectively setting the resonance frequency of said antenna system for any one of FM waves, VHFTV waves and UHFTV waves, to be received by the built-in receiver.

8. An automobile antenna system as defined in any one of claims 1 or 7 wherein said circuit means includes impedance matching means and amplifying means wherein the output impedance of said amplifying means coincides with the characteristic impedance of a coaxial antenna cable.

* * * * *